US007595767B2

(12) United States Patent
Andrenko et al.

(10) Patent No.: US 7,595,767 B2
(45) Date of Patent: Sep. 29, 2009

(54) ANTENNA

(75) Inventors: Andrey Andrenko, Kawasaki (JP); Toru Maniwa, Kawasaki (JP); Hiroyuki Hayashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/808,984

(22) Filed: Jun. 14, 2007

(65) Prior Publication Data

US 2007/0241969 A1 Oct. 18, 2007

Related U.S. Application Data

(63) Continuation of application No. PCT/JP2004/018655, filed on Dec. 14, 2004.

(51) Int. Cl.
*H01Q 9/38* (2006.01)

(52) U.S. Cl. ..... 343/846; 343/830

(58) Field of Classification Search ..... 343/700 MS, 343/752, 830, 846
See application file for complete search history.

(56) References Cited

U.S. PATENT DOCUMENTS

| | | | | |
|---|---|---|---|---|
| 2,541,107 | A | 2/1951 | Selgin | |
| 4,835,539 | A * | 5/1989 | Paschen | 343/700 MS |
| 4,835,540 | A * | 5/1989 | Haruyama et al. | 343/700 MS |
| 5,539,418 | A * | 7/1996 | Egashira et al. | 343/712 |
| 2002/0011953 | A1 | 1/2002 | Reece et al. | |
| 2002/0186169 | A1 | 12/2002 | Iwai et al. | |

FOREIGN PATENT DOCUMENTS

| | | | |
|---|---|---|---|
| EP | 0 247 454 | A | 12/1987 |
| JP | 56-000715 | | 1/1981 |
| JP | 104205/1981 | | 8/1981 |
| JP | 62-66703 | A | 3/1987 |
| JP | 62-109404 | | 5/1987 |
| JP | 62-285502 | A | 12/1987 |
| JP | 03-080603 | | 4/1991 |
| JP | 3-219705 | A | 9/1991 |
| JP | 4-286404 | A | 10/1992 |

(Continued)

OTHER PUBLICATIONS

European Supplementary search report; Application No. 04807014. B-1248 PCT/JP2004018655; Reference No. 122 039 a/fha; dated Oct. 31, 2007; 3-pages.
Japanese Office Action No. 2006-548602 mailed Apr. 30, 2008 with English Translation.
Japanese Office Action No. 2006-548602 dated Aug. 19, 2008 with English Translation.

*Primary Examiner*—Michael C Wimer
(74) *Attorney, Agent, or Firm*—Hanify & King, P.C.

(57) ABSTRACT

An antenna having a construction enabling simple adjustment of impedance at the antenna connection terminal has a grounded plate; a plate-shape radiating conductor, positioned parallel to the grounded plate; a feed line conductor, one end of which is connected to a feed point of the plate-shape radiating conductor, the other end of which is connected, as an antenna terminal, to an inner conductor of a coaxial cable, and which is perpendicular to the plate-shape radiating conductor; and a conductor disc, electrically connected to the feed line conductor, and positioned parallel to the ground plate, the distance from the conductor disc to the grounded plate being adjustable.

4 Claims, 9 Drawing Sheets

FOREIGN PATENT DOCUMENTS

| | | | |
|---|---|---|---|
| JP | 5-95827 | A | 4/1993 |
| JP | 8-28606 | B2 | 3/1996 |
| JP | 8-274535 | A | 10/1996 |
| JP | 2001-128996 | A | 5/2001 |
| JP | 2001-144524 | | 5/2001 |
| JP | 2001-203529 | | 7/2001 |
| JP | 2003-51712 | | 2/2003 |
| JP | 2003-511953 | A | 3/2003 |

* cited by examiner

ANTENNA

CROSS REFERENCE TO RELATED APPLICATIONS

This application is a continuation of International Application No. PCT/JP2004/018655, filed on Dec. 14, 2004, now pending, herein incorporated by reference.

TECHNICAL FIELD

This invention relates to an antenna, and in particular relates to an antenna structure having a structure for simple impedance adjustment in an antenna connection terminal.

BACKGROUND ART

Recently there has been widespread adoption of systems for wireless reading of coded information and similar from objects for reading known as RFID tags.

In such systems, a device to read coded information and similar from RFID tags is called an RFID reader/writer. An RFID tag has an IC memory which stores coded information, but is not provided with a power source, in order to enable miniaturization. Hence the supply of power is necessary in order to read coded information from the IC memory and transmit the coded information wirelessly to the RFID reader/writer.

When the RFID reader/writer reads coded information and similar from an RFID tag, an unmodulated continuous wave (CW) is transmitted to the RFID tag. The RFID tag receives the unmodulated continuous wave, and converts this into a current to receive a supply of power. This power is used to read coded information from the IC memory and to modulate the unmodulated continuous wave and return the modulated wave to the RFID reader/writer. By this means, the RFID reader/writer can read coded information or similar from an RFID tag.

FIG. 1 is a conceptual diagram of an example of the configuration of such an RFID reader/writer. In FIG. 1, an information read processing circuit 3 is connected to an antenna 1 via a coaxial cable 2. The antenna 1 has a plate-shape radiating conductor 10 which is positioned parallel to and opposing a grounded plate 12 by means of insulating supports 11*a* to 11*d*, of Teflon or another material.

In the example shown in FIG. 1, a configuration is employed in which air intervenes between the patch antenna (plate-shape radiating conductor) 10 and the grounded plate 12 by means of the insulating supports 11*a* to 11*d*; but a configuration is also possible in which an insulating plate of Teflon or similar intervenes. The plate-shape radiating conductor 10 further has an electromagnetic wave radiating window 13.

The transmission/reception portion of the information read processing circuit 3 is connected via a circulator 30 to the transmission amplifier(amp)SPA and to the reception amp RAP. Beyond the transmission amp SPA and reception amp RAP is connected a processing circuit, which however is not directly related to this invention, and so is omitted from drawings.

The feed point P of the plate-shape radiating conductor 10 and the circulator 30 are connected by the coaxial cable 2. The unmodulated continuous wave (CW) output from the transmission amp SPA passes through the coaxial cable 2, is supplied to the feed point, and is radiated from the plate-shape radiating conductor 10 toward the RFID tag. The unmodulated continuous wave (CW) is modulated and reflected by the RFID tag, and is received by the plate-shape radiating conductor 10, passes through the coaxial cable, is received by the information read processing circuit 3, and is received from the circulator 30 by the reception amp RPA.

Here, the characteristic impedance of the coaxial cable 2 is 50 Ω. If the impedance of the feed point P is different from the characteristic impedance of the coaxial cable 2, then the unmodulated continuous wave (CW) supplied from the transmission amp SPA is reflected at the feed point.

On the other hand, the RFID reader/writer receives a minute response signal from the RFID tag, and so reflection from the antenna 10 becomes an interference wave, and the sensitivity is lowered. In a normal antenna, even a reflection characteristic of approximately −10 dB is sufficient, but in an RFID reader/writer, a reflection characteristic of −20 dB or lower is desirable.

Various proposals have been made in the prior art with respect to improvement of the antenna reflection characteristics (for example, in Japanese Patent Publication No. 8-8446 and Japanese Patent Laid-open No. 2001-203529). In the invention described in Japanese Patent Publication No. 8-8446, as shown in the plane view of FIG. 2 and the cross-sectional view along line A-A' in FIG. 3, a plate-shape radiating conductor 10 is positioned in opposition to a grounded plate 12, with a dielectric substrate 14 intervening. The position of placement of the feed point P from the center O of the plate-shape radiating conductor 10 is adjusted, and the central conductor 16 of the coaxial cable is connected to the feed point P, while the outer conductor 17 is connected to the grounded plate 12.

As one characteristic, protrusions 15 or cutouts (Japanese Patent Publication No. 8-8446, FIG. 3) are provided on the outer periphery of the plate-shape radiating conductor 10 at positions at prescribed angles from the feed point P of the plate-shape radiating conductor 10, and the sizes thereof are adjusted.

In the invention described in Japanese Patent Laid-open No. 2001-203529, as shown in FIG. 4, a radiating conductor 10 is formed having a cutout 9 in the substrate 20, and a slit 22 is further provided between the feed line 21 and radiating conductor 10. The antenna operating mode is obtained through the width and length of the slit 22, and by adjusting the length the desired impedance matching is obtained.

However, in methods to adjust the position of the feed point in such examples of the prior art, adjustment processing is not easily performed, and moreover there is the problem that the polarization states which occur change with the position of the feed point.

DISCLOSURE OF THE INVENTION

Hence an object of the invention is to provide an antenna for which impedance adjustment is easy.

A first aspect of an antenna which achieves this object of the invention has a grounded plate; a plate-shape radiating conductor, positioned parallel to the grounded plate; a feed line conductor, one end of which is connected to a feed point of the plate-shape radiating conductor, the other end of which is connected, as an antenna terminal, to an inner conductor of a coaxial cable, and which is perpendicular to the plate-shape radiating conductor; and a conductor disc, electrically connected to the feed line conductor, and positioned parallel to the ground plate. The antenna is characterized in that the distance from the conductor disc to the grounded plate can be adjusted.

A second aspect of an antenna which achieves the above object of the invention is the antenna of the first aspect, characterized in that screw threads are formed on the outer periphery of at least a portion of the feed line conductor; the conductor disc has a center portion penetrated by the feed line conductor; thread grooves, which mate with the screw threads of the feed line conductor, are formed in the inner surface of the center portion, and by rotating the conductor disc, the distance from the grounding plate can be adjusted along the screw threads.

A third-aspect of an antenna which achieves this object of the invention has a grounded plate; a plate-shape radiating conductor, positioned parallel to the grounded plate; a first feed line conductor, one end of which is connected to a feed point of the plate-shape radiating conductor, and which is perpendicular to the plate-shape radiating conductor; and a second feed line conductor, one end of which is connected, as an antenna terminal, to an inner conductor of a coaxial cable. The antenna is characterized in that the other end of the first feed line conductor and the other end of the second feed line conductor are positioned so as to be opposed, and in that the size of the opposed area can be adjusted.

A fourth aspect of an antenna which achieves the above object of the invention is the antenna of the third aspect, characterized in that the first feed line conductor is a conducting threaded screw, and in that the second feed line conductor has a hollow conducting tube, and a hollow dielectric body, inserted into at least a portion of the hollow conducting tube, with thread grooves to mate with the threaded screw formed on the inner surface of the hollow dielectric body.

A fifth aspect of an antenna which achieves this object of the invention has a grounded plate; a plate-shape radiating conductor, positioned parallel to the grounded plate; a first feed line conductor, one end of which is connected to a feed point of the plate-shape radiating conductor, and which is perpendicular to the plate-shape radiating conductor; and a second feed line conductor, one end of which is connected, as an antenna terminal, to an inner conductor of a coaxial cable. The antenna is characterized in that other end of the first feed line conductor and the other end of the second feed line conductor are positioned so as to be opposed, in that the size of the opposed area can be adjusted, in having a conductor disc electrically connected to the second feed line conductor and positioned in parallel to and opposing the grounded plate, and in that the distance from the conductor disc to the grounded plate can be adjusted.

Characteristics of the invention will become more clear from the embodiments of the invention, explained below referring to the attached drawings.

BEST MODE FOR CARRYING OUT THE INVENTION

Figure 1:
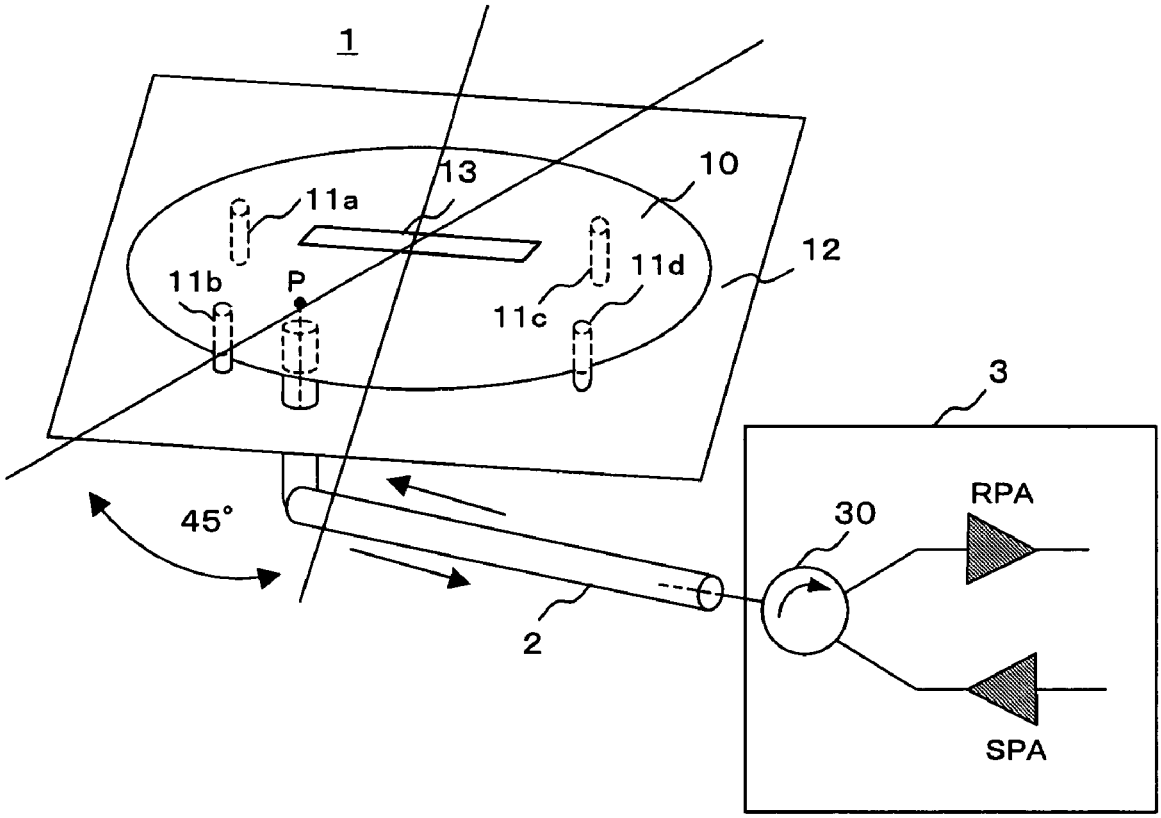
FIG. 1 is a conceptual diagram showing an example of the configuration of an RFID reader/writer.
Figure 2:
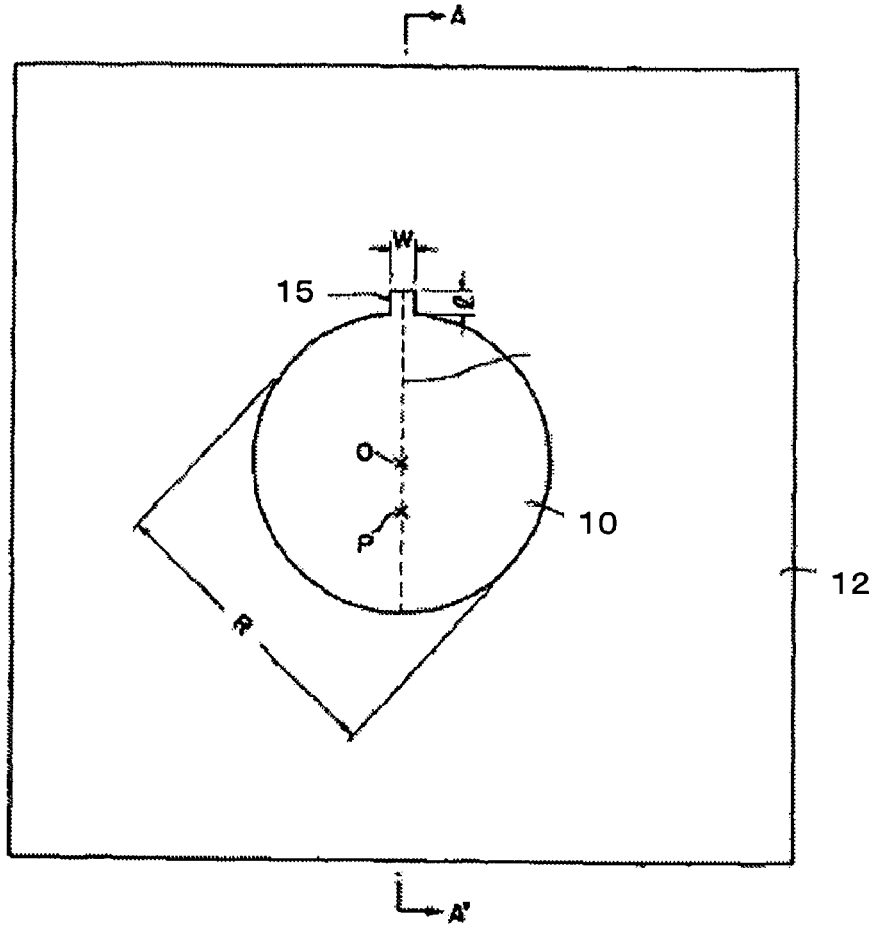
FIG. 2 is a plane view of the invention described in Japanese Patent Publication No. 8-8446.
Figure 3:
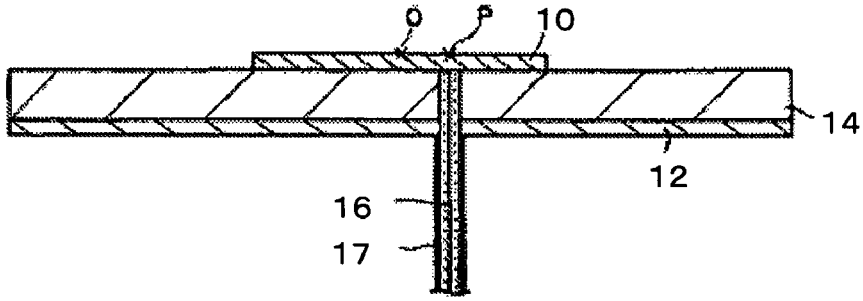
FIG. 3 is a cross-sectional view along line A-A' in FIG. 2.
Figure 4:
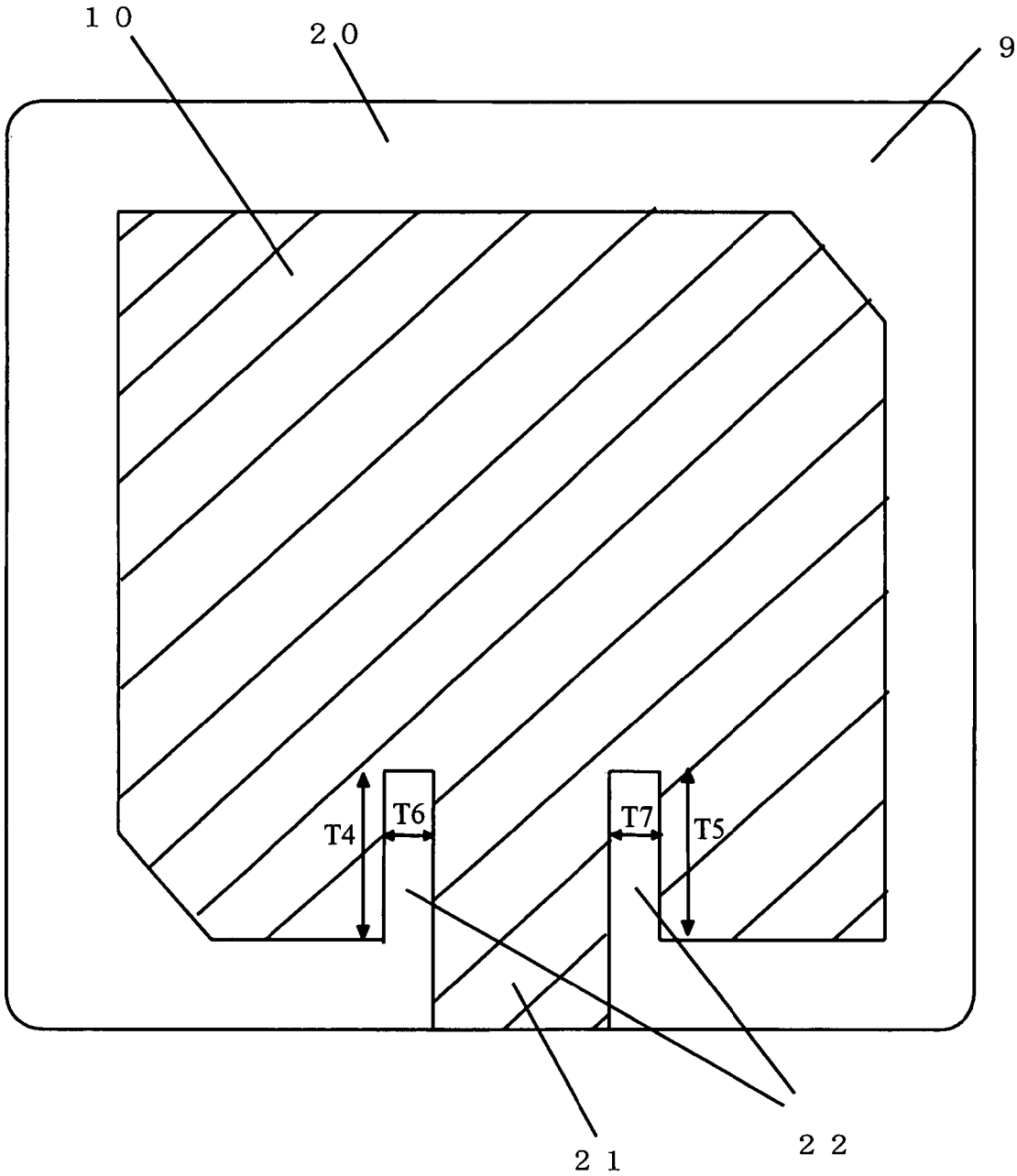
FIG. 4 explains the invention of Japanese Patent Laid-open No. 2001-203529.

Below, preferred aspects of the invention are explained referring to the drawings. The aspects of the invention explained below and provided to facilitate understanding of the invention, and the technical scope of the invention is not limited to these aspects.

Figure 5:
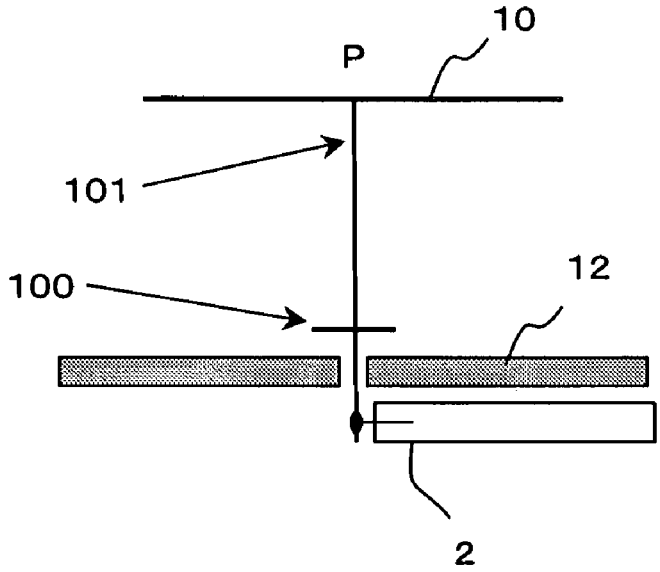
FIG. 5 shows the principle of a first embodiment of an antenna of this invention.

FIG. 5 is a diagram of the principle of a first embodiment of an antenna of this invention, showing a lateral cross-section. The patch antenna (plate-shape radiating conductor) 10 and grounded plate 12 are in parallel and opposed with air intervening, as in the configuration of FIG. 1.

As characteristics, the conductor disc 100 connected to the plate-shape radiating conductor 10 is positioned in parallel, partway along the coaxial feed line conductor 101 connected to the feed point P of the plate-shape radiating conductor 10. In FIG. 5, to facilitate understanding of the construction, the interval between the plate-shape radiating conductor 10 and the grounded plate 12 is shown enlarged compared with the diameter of the plate-shape radiating conductor 10. For example, for a central frequency of 953 MHz, if the diameter of the plate-shape radiating conductor 10 is 15 cm, the interval between the plate-shape radiating conductor 10 and the grounded plate 12 is approximately 1 cm. At this time, the diameter of the conductor disc 100 is 14 mm.

Figure 6:
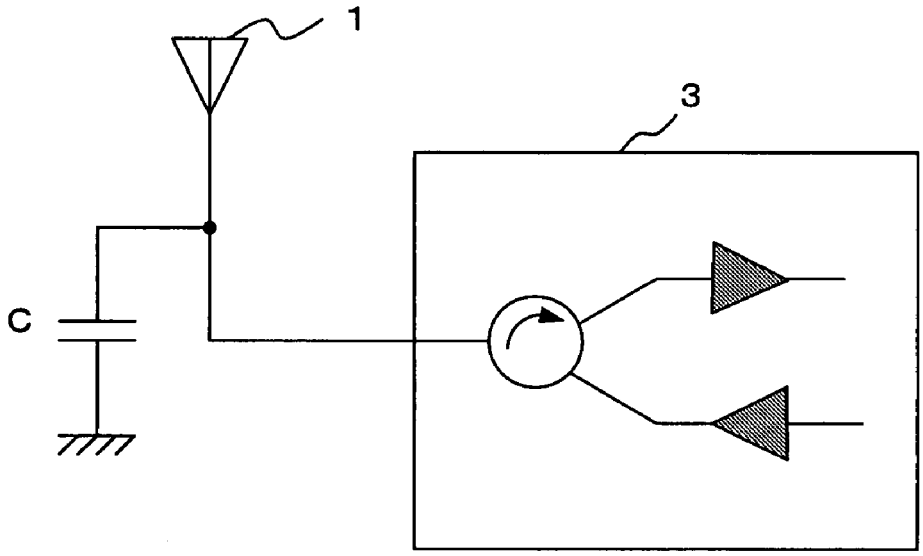
FIG. 6 is an equivalent circuit for the principle diagram of FIG. 5.

FIG. 6 is the equivalent circuit for the principle diagram of FIG. 5. The conductor disc 100 forms a capacitance C with the grounded plate 12, and a capacitance C1 is connected in parallel with the antenna 1. By adjusting the interval between the conductor disc 100 and the grounded plate 12, the coaxial feed line conductor 101 which is the antenna terminal can be brought close to the 50 Ω characteristic impedance of the connection point with the coaxial cable 2. By this means, reflection from the antenna 1 can be reduced.

Figure 7:
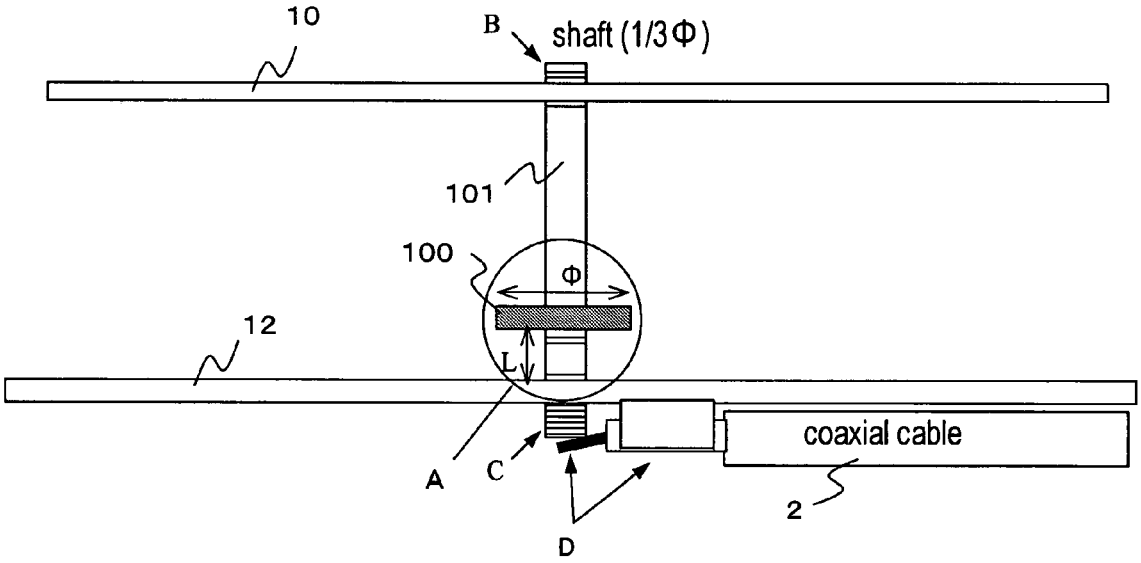
FIG. 7 shows the configuration of an embodiment corresponding to the principle diagram of FIG. 5.
Figure 8:
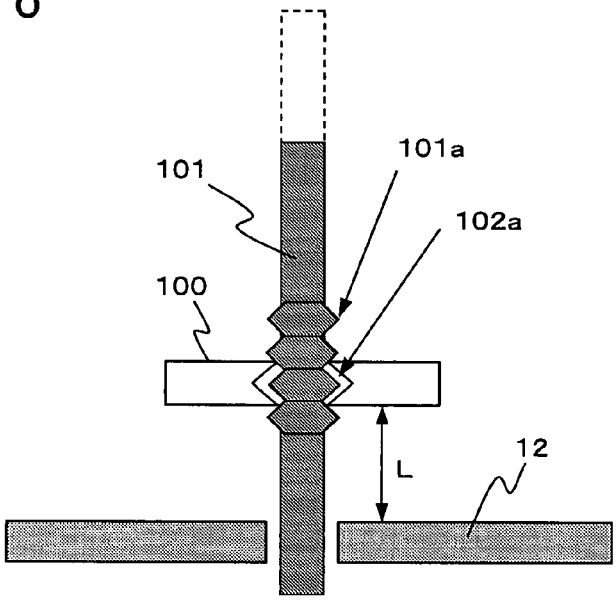
FIG. 8 schematically shows in enlargement the portion A surrounded by a circle in FIG. 7.

FIG. 7 shows the configuration of an embodiment corresponding to the principle diagram of FIG. 5; in this figure also, the construction is shown as a lateral cross-section. FIG. 8 schematically shows in enlargement the portion A-surrounded by a circle in FIG. 7. As the coaxial feed line conductor 101, the conductor shaft is used; the tip portion B and lower end portion C are fixed onto the plate-shape radiating conductor 10 with threads formed and the grounding plate 12, respectively.

Hence the interval between the plate-shape radiating conductor 10 and the grounded plate 12 is determined by the length of the coaxial feed line conductor 101. The lower end portion C of the coaxial feed line conductor 101 is fixed by solder to the inner conductor of the coaxial cable 2. The outer conductor of the coaxial cable 2 is similarly fixed by solder to the grounded plate 12.

If the diameter of the coaxial feed line conductor 101 is ⅓ϕ, then the diameter of the conductor disc 100 is ϕ, and as shown in FIG. 8, thread grooves 102*a* are formed on the inner side penetrated by the coaxial feed line conductor 101. On the other hand, screw threads 101*a*, corresponding to the thread grooves 102*a* of the conductor disc 100, are formed on a portion of the coaxial feed line conductor 101.

Hence by rotating the conductor disc 100, the interval L with the grounded plate 12 along the screw threads 101*a* of the coaxial feed line conductor 101 can be adjusted.

Figure 9:
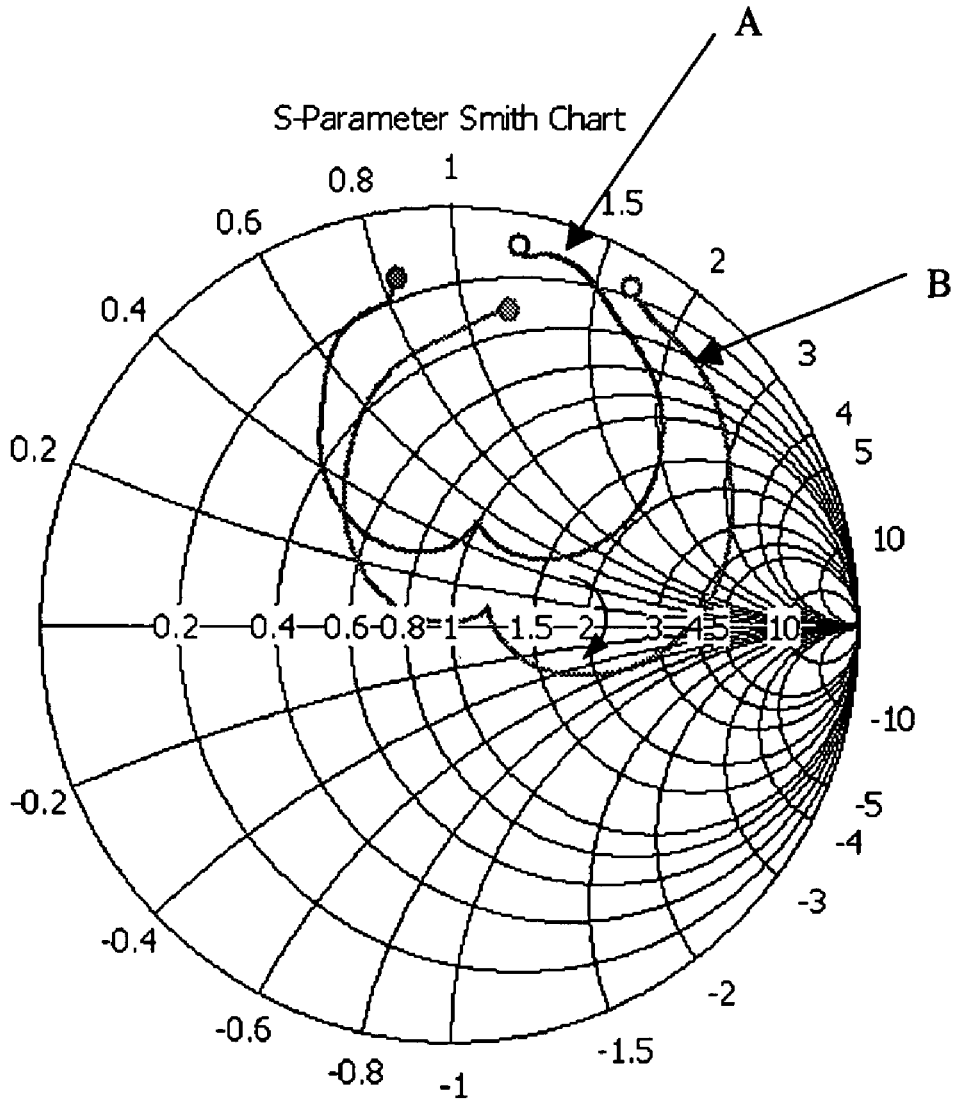
FIG. 9 shows an advantageous result of the invention, using an S-parameter Smith chart.

FIG. 9 shows an advantageous result of the invention, using an S-parameter Smith chart.

In FIG. 9, A is the characteristic of the prior art not having the conductor disc 100 in FIG. 7, and B is the characteristic of the configuration of this invention shown in FIG. 7. In both cases, characteristics for a central frequency of 965 MHz, with frequency fluctuating from 800 MHz to 1.1 GHz, are shown. When the conductor disc 100 is rotated to increase the capacitance C in the direction of the arrow, a characteristic approaching "1" is obtained, and the characteristic impedance of the coaxial cable 2 can be approached.

Figure 10:
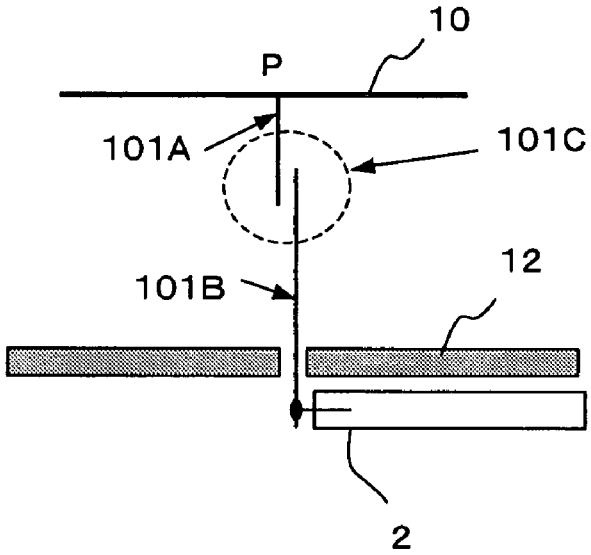
FIG. 10 shows the principle of a second embodiment of the invention.
Figure 11:
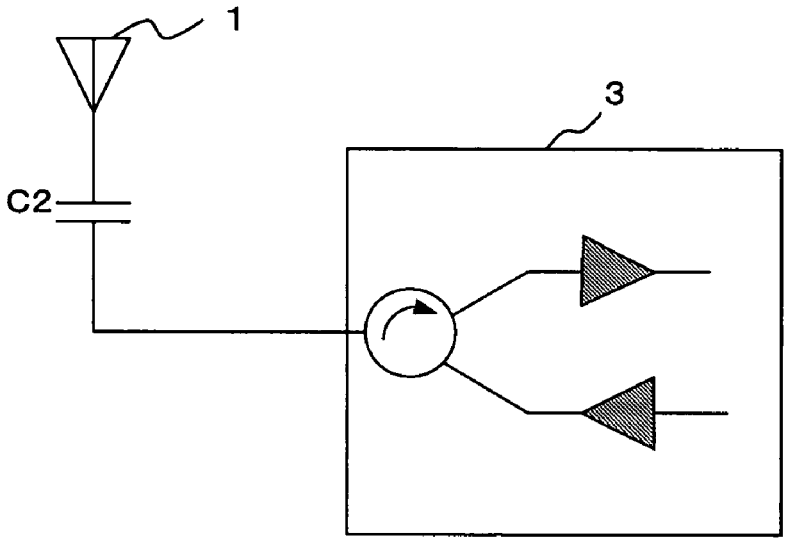
FIG. 11 is an equivalent circuit for the principle diagram of FIG. 10.

FIG. 10 shows the principle of a second embodiment of the invention. FIG. 11 is the equivalent circuit corresponding to the principle diagram of FIG. 10. This second embodiment has a first coaxial feed line conductor 101A, having one end connecting the coaxial feed line conductor 101 to the plate-shape radiating conductor 10, and a second coaxial feed line conductor 101B, having one end connected to the coaxial cable 2; the other ends of each are positioned so as to be opposed, as in the broken-line circle 101C in FIG. 10.

A capacitance C2 is formed as indicated in the equivalent circuit of FIG. 11 by placing these portions in opposition, resulting in a state in which a capacitance C2 is inserted in series with the antenna 1. Hence by changing the size of the opposing area of the coaxial feed line conductors 101A and 101B, the capacitance C2 is adjusted, and so the antenna-side impedance connected to the coaxial cable 2 can be varied, and reflection can be reduced.

Figure 12:
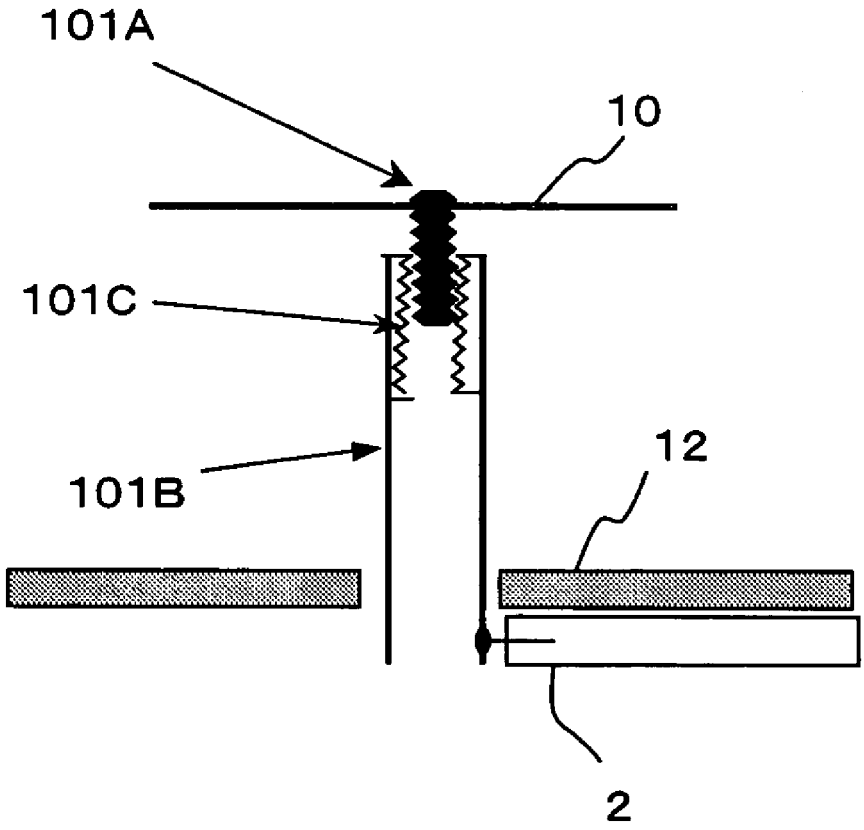
FIG. 12 is a lateral cross-sectional view of an embodiment realizing the principle of the second embodiment shown in FIG. 11.

FIG. 12 is a lateral cross-section of an aspect realizing the principle of the second embodiment shown in FIG. 11.

In FIG. 12, the conducting threaded screw 101A connected to the feed point of the plate-shape radiating conductor 10 is the first coaxial feed line conductor (101A), and the hollow conducting tube 101B, into the interior of which the hollow member 101C, of Teflon or another dielectric, is inserted, is formed as the second coaxial feed line conductor (101B).

On the inner wall of the hollow member 101C, of Teflon or another dielectric, are formed thread grooves corresponding to the screw threads of the threaded screw 101A.

Hence by rotating the threaded screw 101A to adjust the amount of insertion into the hollow member 101C, the opposed area between the first coaxial feed line conductor 101A and the second coaxial feed line conductor 101B can be changed.

Therefore, in the construction shown in FIG. 12, the impedance of the connecting portion with the coaxial cable 2 of the antenna 1 can easily be adjusted so as to approach the characteristic impedance of the coaxial cable 2.

Figure 13:
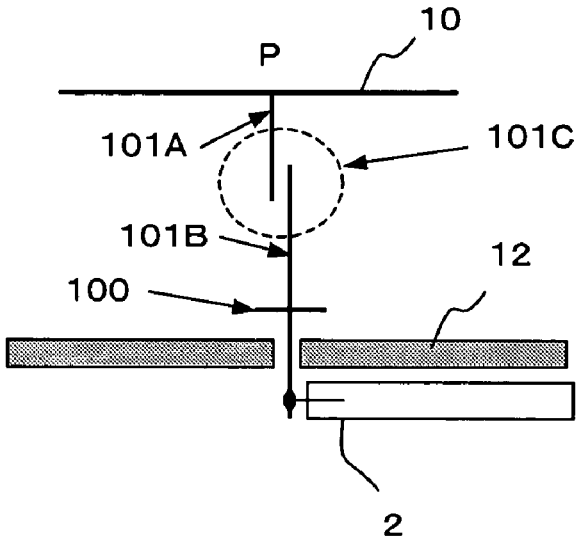
FIG. 13 shows the principle of a third embodiment of the invention.
Figure 14:
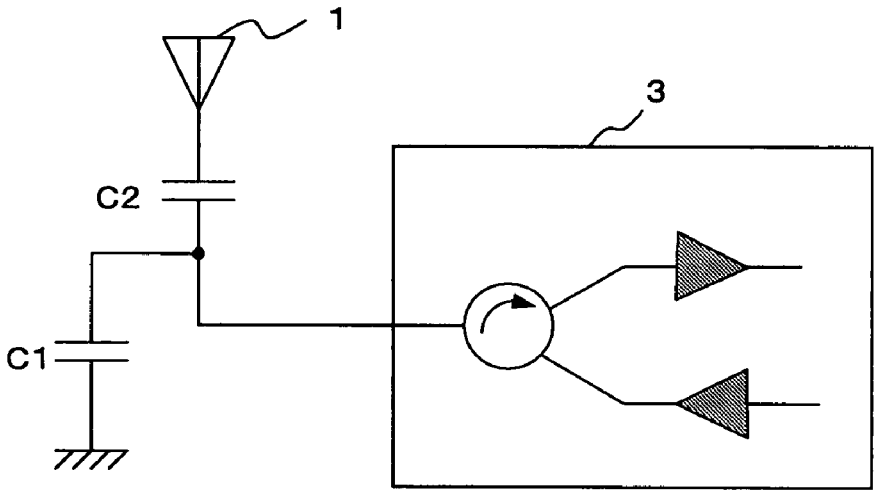
FIG. 14 is an equivalent circuit for the principle diagram of FIG. 13.

FIG. 13 shows the principle of a third embodiment of the invention. This embodiment has a construction which combines the first-embodiment and the second embodiment, in which the opposing area of the conductor disc 100, the first coaxial feed line conductor 101A, and the second coaxial feed line conductor 101B can easily be changed. The equivalent circuit is shown in FIG. 14; through the combination of the parallel capacitance C1 and the series capacitance C2, the reflection characteristic from the antenna terminal can be adjusted more precisely.

In the above explanation of embodiments, examples were described in which the shape of the plate-shape radiating conductor 10 is circular; but application of the invention is not limited to this shape, and a rectangular shape may be used. Also, use of the antenna in RFID reader/writers was described; but application of the invention is not limited to RFID reader/writers, and the invention may be applied to wireless equipment in general.

INDUSTRIAL APPLICABILITY

As explained in the above embodiments, by rotating the conductor disc 100 or the conducting screw 101A, the impedance of the portion connecting the antenna with the coaxial cable 2 can easily be adjusted. Hence an antenna of this invention enables easy adjustment of the characteristic of reflection from the antenna terminal, and the position of the feed point is not changed, so that a method of antenna adjustment is realized which does not affect the polarization characteristics, greatly contributing to reduction of the manufacturing cost of the antenna.

The invention claimed is:

1. An antenna, comprising:

a grounded plate;

a plate-shape radiating conductor, positioned parallel to said grounded plate;

a feed line conductor, one end of which is connected to a feed point of said plate-shape radiating conductor, the other end of which is connected, as an antenna terminal, to an inner conductor of a coaxial cable, and which is perpendicular to said plate-shape radiating conductor; and a conductor disc, electrically connected to said feed line conductor, and positioned parallel to said ground plate, wherein the distance from said conductor disc to said grounded plate can be adjusted, and wherein screw threads are formed on the outer periphery of at least a portion of said feed line conductor, said conductor disc has a center portion penetrated by said feed line conductor, thread grooves which mate with said screw threads of said feed line conductor are formed on the inner surface of said center portion, and by rotating said conductor disc, the distance from said grounding plate can be adjusted along said screw threads.

2. The antenna according to claim 1, wherein the conductor disc is less than approximately 10% of the diameter of the plate-shape radiating conductor.

3. An antenna, comprising:

a grounded plate;

a plate-shape radiating conductor, positioned parallel to said grounded plate;

a first feed line conductor, one end of which is connected to a feed point of said plate-shape radiating conductor, and which is perpendicular to said plate-shape radiating conductor; and a second feed line conductor, one end of which is connected, as an antenna terminal, to an inner conductor of a coaxial cable, wherein the other end of said first feed line conductor and the other end of said second feed line conductor are positioned so as to be opposed, and the size of the opposed area can be adjusted, wherein said first feed line conductor is a conducting threaded screw, and said second feed line conductor has a hollow conducting tube, and a hollow dielectric body, inserted into at least a portion of said hollow conducting tube, with thread grooves to mate with said threaded screw formed on the inner surface of said hollow dielectric body.

4. The antenna according to claim 3 further comprising:

a conductor disc electrically connected to said second feed line conductor and positioned in parallel to and opposing said grounded plate, wherein the distance from said conductor disc to said grounded plate can be adjusted.

* * * * *